United States Patent [19]

Miyasaka et al.

[11] 3,939,647

[45] Feb. 24, 1976

[54] STRUCTURE OF WATER-TIGHT WATCH CASE

[75] Inventors: Tsutomu Miyasaka; Akio Kitazume, both of Suwa, Japan

[73] Assignee: Kabushiki Kaisha Suwa Seikosha, Tokyo, Japan

[22] Filed: Aug. 19, 1974

[21] Appl. No.: 498,872

[30] Foreign Application Priority Data

Aug. 24, 1973 Japan ..... 48-94340

[52] U.S. Cl. ..... 58/90 R

[51] Int. Cl.[2] ..... G04B 37/08

[58] Field of Search ..... 58/90 R

[56] References Cited

UNITED STATES PATENTS

| | | | |
|---|---|---|---|
| 3,264,820 | 8/1966 | Piquerez | 58/90 R |
| 3,782,105 | 1/1974 | Nozawa | 58/90 R |
| 3,822,546 | 7/1974 | Seikosha | 58/90 R |
| 3,841,085 | 10/1974 | Akahane | 58/90 R |
| 3,849,981 | 11/1974 | Tarusawa et al. | 58/90 R |

*Primary Examiner*—George H. Miller, Jr.

*Attorney, Agent, or Firm*—Haseltine, Lake & Waters

[57] ABSTRACT

A water-tight watch case in which an elastic gasket interposed between an inner case body and a glass or a glass frame formed as a part of glass is pressed, by engaging projections provided on both ends of an elastic leaf spring or an elastic bar incorporated in a groove provided on the outer periphery of said inner case body formed as a part of a back cover, into a groove provided on an outer case body formed as a part of a bezel.

12 Claims, 22 Drawing Figures

STRUCTURE OF WATER-TIGHT WATCH CASE

FIELD OF INVENTION

This invention relates to structures pertaining to the engagement between an outer case body and an inner case body of a water-tight watch case.

BACKGROUND

In one conventional mechanism, water-tightness is obtained in a watch case by engaging the inner case body directly with the outer case body and pressing a gasket between the inner case body and a glass. This conventional mechanism, however, has a complicated manufacture and unstable water-tightness.

Another known structure, as will be described in detail hereinafter, is such that water-tightness is obtained by engaging a pin fixed to a leaf spring into a groove provided on an outer case body and pressing a gasket between the inner case body and a glass. In this structure, the fixation of a pin to a leaf spring makes it difficult to obtain accuracy in manufacture and, furthermore, the water-tightness is unstable. Moreover, since it is necessary to make the leaf spring large in width for facilitating the fixing of the pin to the leaf spring, the thickness of the inner case body must be large. Therefore, the outer case body must be very thick, which spoils the outward appearance thereof.

SUMMARY OF INVENTION

It is an object of this invention to eliminate the abovementioned defects.

To achieve the above and other objects of the invention, there is provided in accordance with the invention, a water-tight watch case comprising outer and inner case bodies, glass means, an elastic gasket between said glass means and said inner case body, said outer case body sandwiching said glass means and gasket against said inner case body to provide a water-tight relation, said bodies being provided with opposed openings and extended elastic means in one of the openings and projections on and integral with said extended elastic means at opposite ends of the latter to engage in the other of said openings.

The aforesaid openings may be facing grooves and the outer case body will preferably encircle the inner case body.

As a feature of the invention, the aforesaid projections may be provided with cam surfaces. Moreover, the projections may be toed-in folds, toed-out folds, or may extend at right angles to the elastic means, or may alternatively be transverse folds or may of solid construction.

The elastic means may be constituted in the form of a leaf spring or as an elastic bar.

BRIEF DESCRIPTION OF DRAWING

The invention will next be described in greater detail with reference to the attached drawings in which.

DETAILED DESCRIPTION

Figure 1:
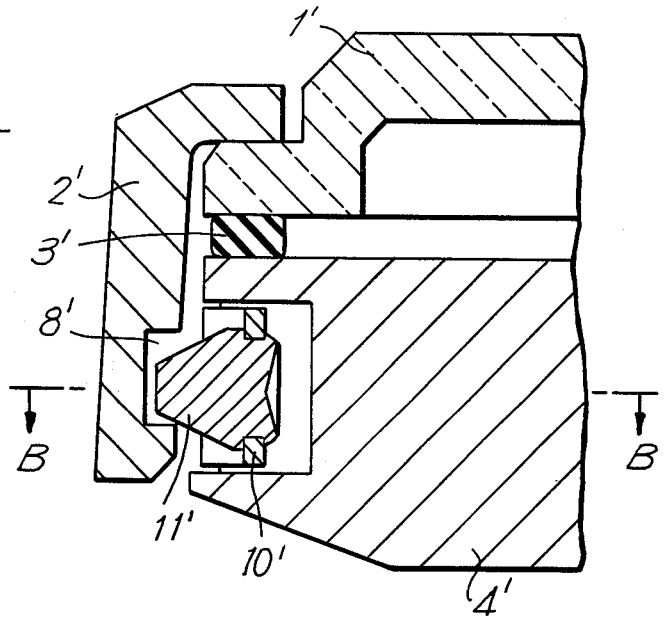
FIG. 1 PRIOR ART
FIG. 1 is a fragmentary longitudinal sectional view (taken along line A—A of FIG. 2) showing a conventional water-tight watch case.
Figure 2:
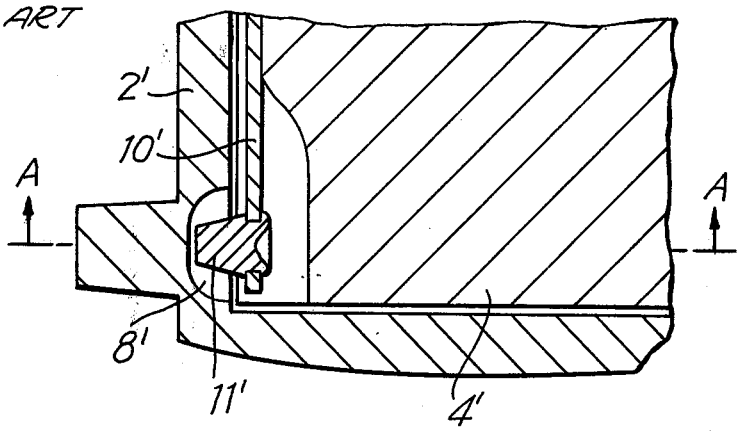
FIG. 2 PRIOR ART
FIG. 2 is a fragmentary sectional view taken along line B—B of FIG. 1 showing other structure of the same water-tight watch case.

The prior art construction illustrated in FIGS. 1 and 2 enables water-tightness to be obtained in a watch case construction, by engaging the inner case body directly with the outer case body and pressing a gasket between the inner case body and a glass. This conventional mechanism, however, has a complicated manufacturing procedure and is characterized by unstable water-tightness.

More specifically, water-tightness is obtained by engaging a pin 11′, which is fixed to a leaf spring 10′, into a groove 8′, the leaf spring 10′ being accommodated in a facing groove. The outer case body 2′ encircles the inner case body 4′ and is provided with a flange which sandwiches the glass 1′ and a gasket 3′ between the outer case body 2′ and the inner case body 4′.

In this structure, the step of fixing a pin to a leaf spring makes it difficult to obtain accuracy in manufacture. Moreover, the water-tightness afforded in such a structure is unstable and unpredictable. Furthermore, it is essential to make the leaf spring 10′ comparatively large in width for facilitating the fixing of the pin 11′ thereto. Therefore, the thickness of the inner case body must also be large and the outer case body must be very thick which spoils the appearance of the watch.

Figure 3:
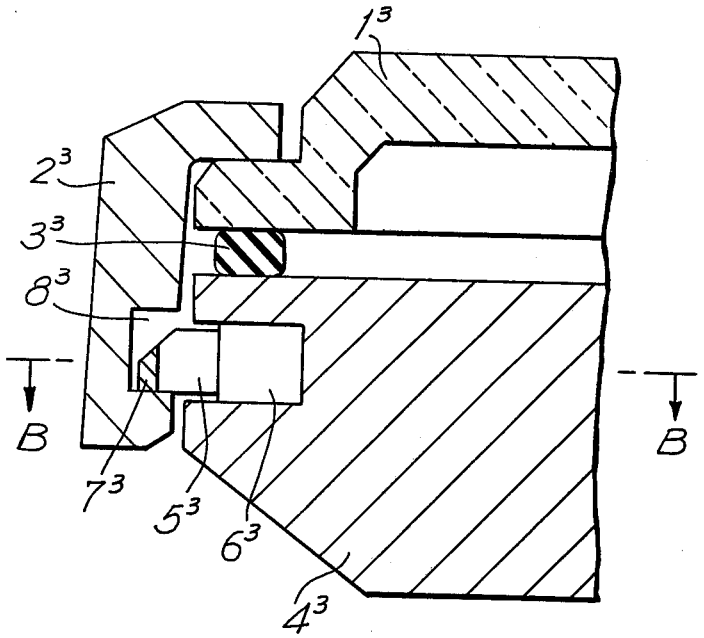
FIG. 3 is a fragmentary longitudinal sectional view (taken along line A′—A′ of FIG. 4) showing a water-tight watch case according to an embodiment of this invention.
Figure 4:
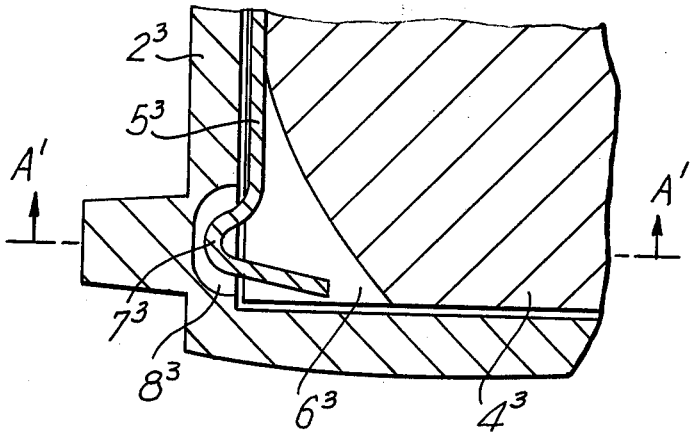
FIG. 4 is a fragmentary sectional view taken along line B—B of FIG. 3.
Figure 5:
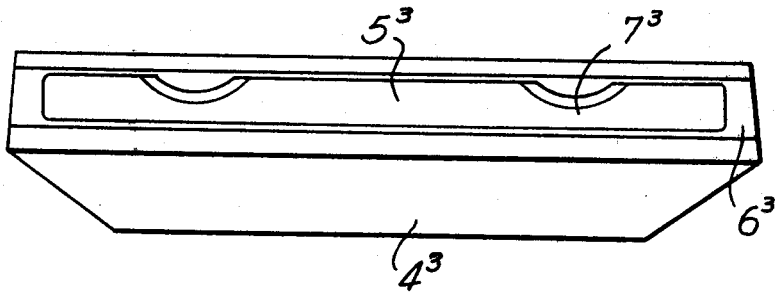
FIG. 5 is a side view showing the outer periphery of the inner case body of the structure of FIGS. 3 and 4.

In FIGS. 3, 4 and 5, element $1^3$ is a glass. Component $2^3$ is an outer case body formed as a part of a bezel. Element $3^3$ is an elastic gasket and element $4^3$ is an inner case body formed as a part of a back cover. The outer case body and the inner case body are joined by engaging projections $7^3$, provided on both ends of an elastic leaf spring $5^3$ located in a groove $6^3$ on the outer periphery of the inner case body, within a groove $8^3$ provided on the outer case body $2^3$.

The inner case body $4^3$ is accommodated within the outer case body $2^3$ and the outer case body $2^3$ is pushed down against the inner case body $4^3$ by the action of the projections $7^3$ provided on both ends of the elastic leaf spring $5^3$, thereby pressing the elastic gasket $3^3$ between the glass $1^3$ and the inner case body $4^3$. The ends of leaf spring $5^3$ are free as such ends are on cantilever portions of the spring $5^3$ as evident from FIG. 4.

As above-mentioned, according to this invention, water-tightness is obtained with a small number of component parts, and without requiring complicated and difficult manufacture.

Further, since means such as used in the conventional water-tight watch case such as the fixing of a pin to a leaf spring is not used in this invention, there is no useless portion involved and the width of the leaf spring can be reduced. Therefore, the thickness of the inner case body in which a leaf spring is incorporated can be reduced.

Accordingly, the outer case body $2^3$ can be made very thin, as a result of which the whole watch case can be made thinner. Thus, the outer appearance, which is important for a watch case, can be improved remarkably.

FIGS. 6*a–g* are perspective views showing projections provided on both ends of the elastic leaf spring or elastic bar $5^3$ according to this invention. Each form of projection $7^1$–$7^7$ is designed so as to engage readily with the groove provided in the outer case body $2^3$. Such projections are formed as integral bent portions on the free ends of the leaf spring or elastic bar as evident in FIGS. 6*a*–6*g*.

Figure 6A:
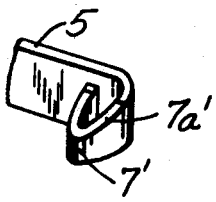
FIGS. 6*a–g* are perspective views each showing a projection provided on both ends of an elastic leaf spring or an elastic bar according to this invention.
Figure 6B:
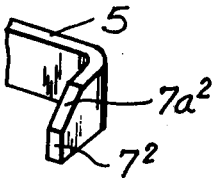
Figure 6C:
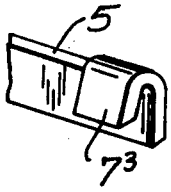
Figure 6D:
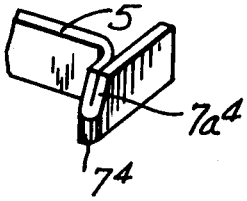
Figure 6E:
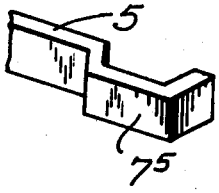
Figure 6F:
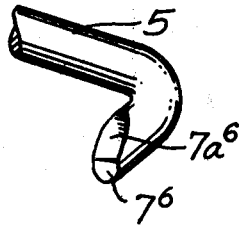
Figure 6G:
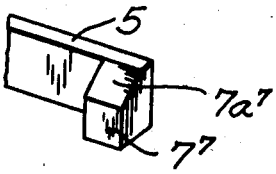

The projections $7^1$–$7^7$ take various forms in which they constitute toed-in folds, such as appears in FIG. 6*a*, or toed-out folds such as appears in FIG. 6*d*. The projections may extend directly outward in the form of right angle projections, such as appears in FIGS. 6*b*, 6*f* and 6*g*, the projections in 6*f* and 6*g* being wider and therefore of a "solid" construction rather than a folded construction. Alternatively, the projection may constitute a transverse fold as appears in FIG. 6*c*. From FIG. 3 it is seen that the lower bearing face of the projection $7^3$ is flat and makes face-to-face contact with the lower flat edge of groove $8^3$ as distinguished by the substantial line contact of the prior art embodiment of FIG. 1.

Further, in order to improve the efficiency of assembly, an inclined cam surface $7a^1$–$7a^7$ may be provided on the upper part of the associated projection. Thus, the form of the projection may also be designed so that the outer case body $2^3$ slides on this inclined surface $7a^{1-7}$.

FIGS. 7*a*–7*i* are sectional views showing elastic leaf springs or elastic bars $5^1$–$5^9$ according to this invention. Quadrilateral forms, round forms or elliptical forms or combinations of the same will do.

Figures 7A, 7B, 7C, 7D, 7E:
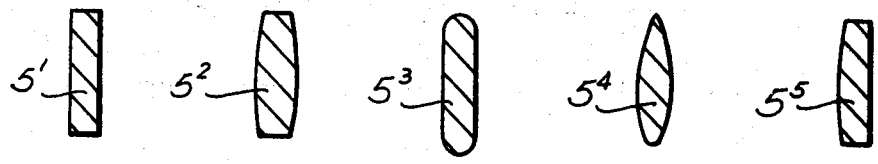
FIGS. 7*a–i* are sectional views each showing a form of an elastic bar according to this invention.
Figures 7F, 7G, 7H, 7I:
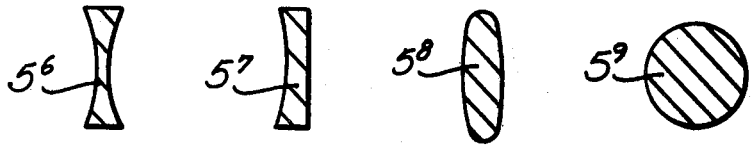

As also may be seen in FIGS. 7*a–i*, the quadrilateral forms may be rectangular as in FIG. 7*a*, or oval as in FIG. 7*h*, or round as in FIG. 7*i*, or various combinations of the same which in cross-section appear bi-concave or bi-convex, as for example, in FIGS. 7*b* and 7*f*.

Figure 8:
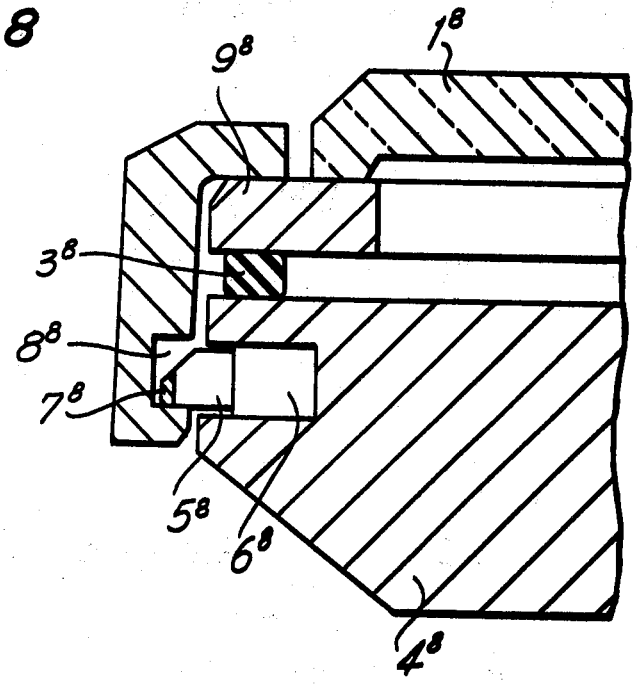
FIG. 8 is a fragmentary longitudinal sectional view showing another embodiment applying this invention to a structure including a glass frame formed as a part of a glass.

FIG. 8 is a partially longitudinal sectional view showing an embodiment applying this invention to a structure for pressing an elastic gasket between a glass frame $9^8$ formed as a part of the glass $1^8$ and the inner case body $4^8$. The glass $1^8$ and the glass frame $9^8$ are constructed as a unit by means of an adhering agent or caulking, or the like thereby obtaining the water-tightness.

What is claimed is:

1. A water-tight watch case comprising outer and inner case bodies, glass means, an elastic gasket between said glass means and said inner case body, said outer case body sandwiching said glass means and gasket against said inner case body to provide a water-tight relation, said bodies being provided with opposed openings, an extended elastic element in one of the openings, said elastic element having free opposite ends with integral projections at said ends engaged in the other of said openings to press the gasket between the glass means and inner case body, said elastic element being secured in said one opening with its free ends extending in cantilever fashion such that said projections are resiliently engaged in said other of the openings.

2. A case as claimed in claim 1 wherein said other opening has a flat bounding edge surface and said projections have a flat planar surface in face-to-face contact with said bounding edge of said other opening.

3. A case as claimed in claim 1 wherein said openings are facing grooves.

4. A case as claimed in claim 3 wherein said outer case body encircles said inner case body.

5. A case as claimed in claim 4 wherein said projections have cam surfaces.

6. A case as claimed in claim 4 wherein said projections are toed in folds.

7. A case as claimed in claim 4 wherein said projections are toed out folds.

8. A case as claimed in claim 4 wherein said projections extend at right angles to the remainder of the elastic element.

9. A case as claimed in claim 4 wherein said projections are transversal folds.

10. A case as claimed in claim 4 wherein said projections are solid.

11. A case as claimed in claim 4 wherein said elastic element is a leaf spring.

12. A case as claimed in claim 4 wherein said elastic element is an elastic bar.

* * * * *